US010926423B1

(12) United States Patent
Panosian et al.

(10) Patent No.: US 10,926,423 B1
(45) Date of Patent: Feb. 23, 2021

(54) INTERCHANGEABLE DIFFERENT STYLE-BLADE UTILITY KNIFE

(71) Applicant: TOUGHBUILT INDUSTRIES, INC., Lake Forest, CA (US)

(72) Inventors: Michael H. Panosian, Irvine, CA (US); Joshua Keeler, Lake Forest, CA (US)

(73) Assignee: TOUGHBUILT INDUSTRIES, INC., Lake Forest, CA (US)

( * ) Notice: Subject to any disclaimer, the term of this patent is extended or adjusted under 35 U.S.C. 154(b) by 0 days.

(21) Appl. No.: 16/852,951

(22) Filed: Apr. 20, 2020

(51) Int. Cl.
*B26B 5/00* (2006.01)
*B26B 9/02* (2006.01)

(52) U.S. Cl.
CPC ..... *B26B 5/00* (2013.01); *B26B 9/02* (2013.01); *B26B 5/003* (2013.01); *B26B 5/006* (2013.01)

(58) Field of Classification Search
CPC .. B26B 5/00; B26B 9/02; B26B 5/003; B26B 5/006; B26B 9/00
See application file for complete search history.

(56) References Cited

U.S. PATENT DOCUMENTS 2,267,059 A * 12/1941 Voight ..... B26B 5/00 30/320
4,180,909 A * 1/1980 Lind ..... B26B 5/00 30/332
4,425,709 A 1/1984 Quenzi
6,701,626 B2 3/2004 Knoop
8,677,630 B2 * 3/2014 Constantine ..... B26B 5/001 30/125
8,739,414 B2 * 6/2014 Tyers ..... B25F 1/00 30/162
8,834,509 B2 9/2014 Holzapfel et al.
8,938,883 B2 * 1/2015 Gringer ..... B26B 1/048 30/155
8,978,254 B1 3/2015 White
9,687,987 B2 * 6/2017 Bloch ..... B26B 9/00
10,478,218 B2 * 11/2019 Wendenburg ..... A61B 17/3213
10,493,639 B2 * 12/2019 Medhurst ..... B26B 1/02
10,518,425 B2 * 12/2019 Bloch ..... B26B 9/00
2004/0163264 A1 8/2004 Simonz
2007/0294895 A1 * 12/2007 Ping ..... B26B 5/00 30/156
2008/0052913 A1 * 3/2008 Cheng ..... B26B 5/00 30/157

(Continued)

*Primary Examiner* — Omar Flores Sanchez
(74) *Attorney, Agent, or Firm* — Nolte Lackenbach Siegel; Myron Greenspan

(57) ABSTRACT

An interchangeable different style-blade utility knife includes an elongate handle having proximal and distal ends along a handle axis. A blade holder is provided for supporting a blade and actuating means is provided for selectively attaching and detaching the blade holder to the distal end of the handle at a parting line. A blade is supported by the blade holder and has an exposed cutting edge generally along a lower side of the handle and has a projected predetermined length along the axis. The blade holder has a support upper portion generally along an upper side of the handle and has a projected length along the axis substantially equal to or generally proportional to the predetermined length to provide support for the blade. A kit includes a plurality of blade holders each with a different style blade, each blade holder having a support upper portion proportional to an associated blade.

15 Claims, 1 Drawing Sheet

(56) References Cited

U.S. PATENT DOCUMENTS

| | | | | |
|---|---|---|---|---|
| 2014/0190018 | A1* | 7/2014 | Segler | B26B 9/00 30/278 |
| 2014/0216605 | A1* | 8/2014 | Batty | B23P 15/44 142/56 |
| 2014/0373364 | A1* | 12/2014 | Li | B26B 1/02 30/152 |
| 2016/0271809 | A1* | 9/2016 | Bloch | B26B 9/00 |
| 2017/0348863 | A1* | 12/2017 | Kommer | B26B 9/00 |
| 2018/0036894 | A1* | 2/2018 | Bloch | B26B 5/00 |
| 2018/0326599 | A1* | 11/2018 | Garavaglia | B26B 29/02 |
| 2019/0069919 | A1* | 3/2019 | Swoish | B25G 1/102 |
| 2019/0217489 | A1* | 7/2019 | Cheng | B26B 1/044 |
| 2019/0321991 | A1* | 10/2019 | Medhurst | B26B 5/00 |
| 2020/0086511 | A1* | 3/2020 | Hayes | B26B 5/006 |
| 2020/0101633 | A1* | 4/2020 | Halucha | B26B 5/00 |
| 2020/0130203 | A1* | 4/2020 | Wang | B26B 5/00 |

* cited by examiner

INTERCHANGEABLE DIFFERENT STYLE-BLADE UTILITY KNIFE

BACKGROUND OF THE INVENTION

1. Field of the Invention

The invention generally relates to utility knives and, more specifically, to an interchangeable different style-blade utility knife.

2. Description of the Prior Art

Utility knives with interchangeable blades are known. When blades become dull they can readily be replaced by like blades. Interchangeable blade utility knives are disclosed, for example, in U.S. Pat. No. 4,180,909 that discloses a knife with interchangeable blades. A hand tool with different changeable blades is also disclosed in U.S. Pat. No. 6,701,626. Interchangeable different blade types are disclosed in U.S. Pat. No. 4,425,709. U.S. Published Patent Application No. 2004/0163264 discloses a hand saw and also a kit of different style blades that can be received within a handle. In the aforementioned devices the blades are relatively thick and do not require nor are provided with support on the sides opposite the cutting edges to prevent breakage.

U.S. Pat. No. 8,834,509 discloses a utility tool having interchangeable tool cartridges. The patent shows, for example, a saw, a knife, a scraper, a hook blade and a screw driver. The utility knife disclosed in this patent uses identical cartridge housings providing the same support for all blade types along the non-cutting edges opposite to the cutting edges, rendering some blade types more vulnerable to breakage than others depending on their shape and/or length of the cutting edges.

This problem also is exemplified in U.S. Pat. No. 8,978,254 where the same blade holder that provides the same support to a conventional or standard flat edge blade as to a curved cutting blade in the nature of a knife blade. This becomes especially problematic for thinner blades, potentially leading to breakage and user injury. In the case of utility cutting blades, irrespective of the style or shape, one support member or cartridge cannot generally provide the same degree of support without compromising the exposure and effectiveness of the blades' cutting edges.

SUMMARY OF THE INVENTION

Accordingly, it is an object of the invention to provide an interchangeable different style-blade utility knife that does not have the disadvantages associated with known utility knives.

It is another object of the invention to provide an interchangeable different style-blade utility knife that utilizes blade holders specifically dimensioned to provide proper support for different-style blades regardless of their size or configuration.

It is still another object of the invention to provide an interchangeable different style-blade utility knife that is simple in construction and economical to manufacture.

It is yet another object of the invention to provide an interchangeable different style-blade utility knife as in the previous objects that is easy and convenient to use.

It is a further object of the invention to provide an interchangeable different style-blade utility knife of the type under discussion that is suitable for thicker as well as thinner utility knife blades, irrespective of their size or shape.

It is still a further object of the invention to provide an interchangeable different style-blade utility knife as in the previous objects that is safe to use by reducing or eliminating breakage of generally sharp utility blades.

In order to achieve the above objects as well as other that will become evident hereinafter, an interchangeable different-style blade utility knife comprising a generally elongate handle having a proximal end and a distal end along a handle axis. A blade holder supports a blade. An actuating mechanism on the handle allows a user to selectively attach and detach the blade holder to the distal end of the handle at a parting line. A blade is supported by the blade holder and has an exposed cutting edge generally along a lower side of the handle and has a projected predetermined length along said axis handle, the blade holder having a support upper portion generally along an upper side of the handle from the parting line to a distal end of the support upper portion and having a projected length along the axis substantially equal to the predetermined length of the exposed cutting edge to provide support for the blade.

BRIEF DESCRIPTION OF THE DRAWINGS

The above and other aspects, features and advantages of the present invention will be more apparent from the following description when taken in conjunction with the accompanying drawings, in which.

DESCRIPTION OF PREFERRED EMBODIMENTS

Figure 1:
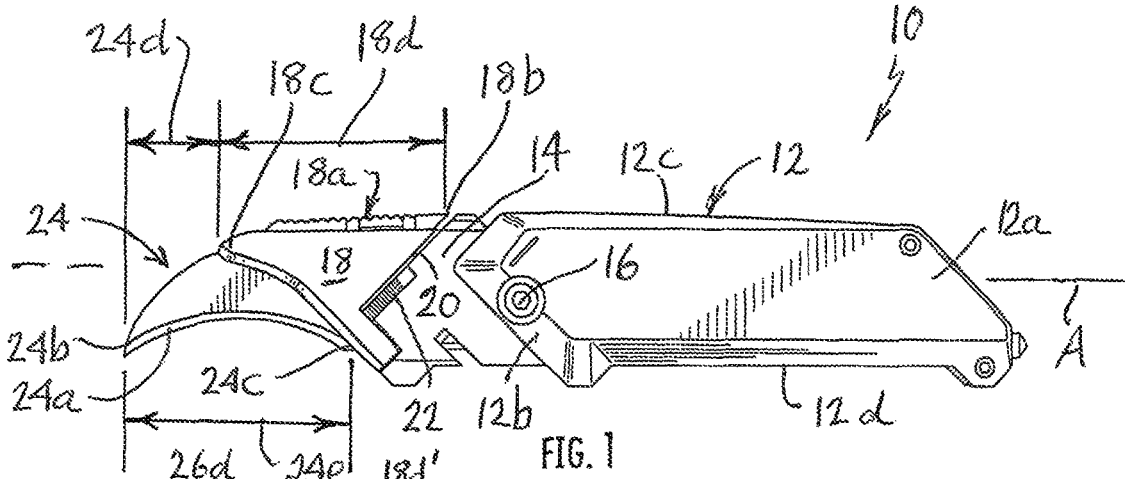
FIG. 1 is a side elevational view of a interchangeable different style-blade utility knife in accordance with the invention with a blade holder for supporting a hook style blade having an inwardly directed or concave shaped cutting edge.

Referring now specifically to the figures, in which identical or similar parts are designated by the same reference numerals throughout, and first referring to FIG. 1, the interchangeable different style-blade utility knife is generally designated by the reference numeral 10.

The interchangeable different blade style utility knife 10 includes a generally elongate handle 12 that defines an axis A and has a proximal end 12*a*, a distal end 12*b*, an upper edge 12*c* and a lower edge 12*d*. An optional handle extension 14 is fixed to the handle 12 but pivotably mounted thereon by pivot 16 to allow the extension to pivot up to approximally 180° from the position shown to a retracted position within the handle when the handle is provided with an internal cavity (not shown).

A blade holder 18 is configured to have a blade support portion 18*a* generally along the upper edge 12*c* of the handle, and be attached and detached from the handle 12 along a parting line 20 for selectively attaching and detaching the blade holder 18 to the handle extension 14. An externally accessible button 22 is used to actuate a latch mechanism (not shown) to selectively attach or detach the blade holder 18 from the handle 12. The specific shape of the parting line 20 or the latch mechanism used to connect or disconnect the blade holder from the handle is not critical. When a pivotable extension 14 is not used the blade holder 18 can be directly attached to the distal end 12*b* of the handle along a similar or any other desired parting line configuration.

A blade 24 may be supported by the blade holder 18 in any conventional or known manner. The blade 24 may be secured to the blade holder 18 and intergrated therewith to form a substantially unitary module or cartridge consisting of the blade holder 18 and the blade 24.

The blade 24, as viewed in FIG. 1, has an exposed cutting edge 24*a* generally along the lower side or edge 12*d* of the handle 12. The blade has a distal end or tip 24*b* and a proximal end 24*c* of the cutting edge at the point of initial exposure from the blade holder 18.

The distance or dimension 18*d* is the distance between the proximal and distal ends 18*b*, 18*c*, respectively, as projected along the axis A. The distance 24*d* represents the dimension between the distal end 18*c* of the handle extension 18 and the tip of the blade 24*b*. Similarly, the dimension 24*e* represents the distance or dimension of the cutting edge 24*a*, as projected along the axis A.

Figure 2:
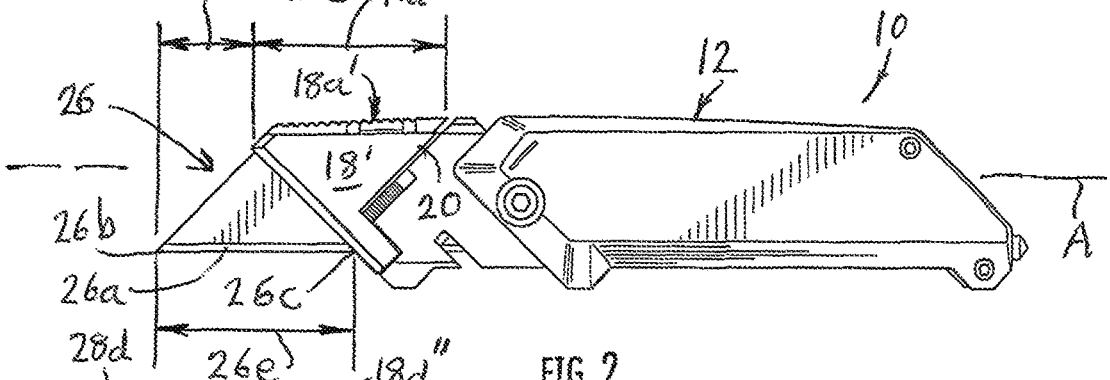
FIG. 2 is similar to FIG. 1 but shows a blade holder for supporting a standard utility knife blade having a straight cutting edge.
Figure 3:
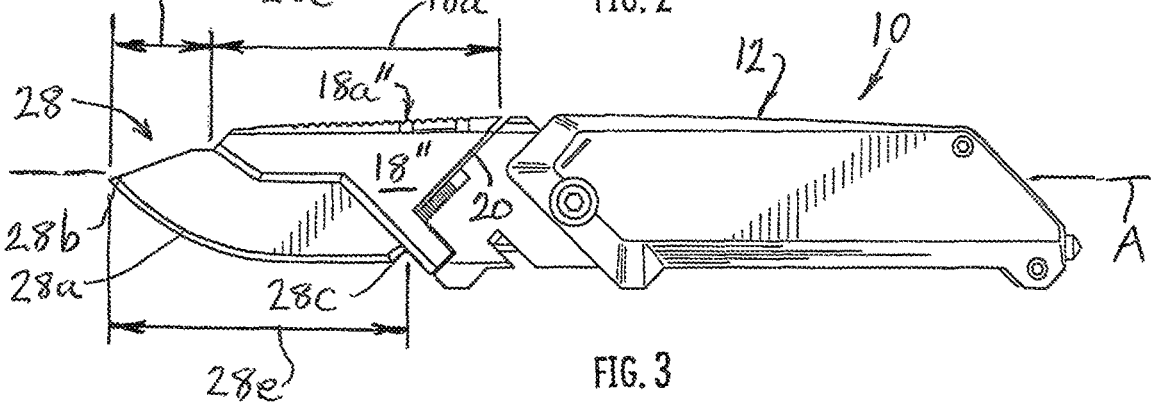
FIG. 3 is similar to FIGS. 1 and 2 but shows a blade holder for supporting a scalpel-shaped blade with a convex cutting edge.

Referring to FIG. 2, a standard or conventional straight edge blade 26 is shown while in FIG. 3 a scalpel-shaped blade 28 is shown. The dimensions 18*d*' and 18*d*" in FIGS. 2 and 3, respectively, correspond to the dimension 18*d* in FIG. 1. Similarly, the dimension 26*d* and 28*d* in FIGS. 2 and 3, respectively, correspond to the dimension 24*d* in FIG. 1. Also, the dimensions 26*e* and 28*e* correspond to the dimension 24*e* in FIG. 1. All these dimensions are projections measured along the axis A.

Dimensions 24*d*, 26*d* and 28*d* respectively in FIGS. 1, 2 and 3 are generally or substantially equal. However, the linear dimensions 18*c*, 18*c*' and 18*c*" of the support portions 18*a*, 18*a*' and 18*a*" in FIGS. 1, 2 and 3 are generally or approximally equal to the dimensions 24*e*, 26*e* and 28*e* in FIGS. 1, 2 and 3, respectively. The dimensions of the blade support portions along the upper edges or sides 12*c* of the handle, therefore, generally correspond to the projected lengths or dimensions of the cutting edges taken along the axis A.

The blade holders 18, 18', 18", therefore, have support upper portions 18*a*, 18*a*' and 18*a*" generally along the upper edge 12*c* of the handle that have projected lengths along the axis substantially equal and/or generally proportional to the projected lengths 24*e*, 26*c* and 28*e* of the blade cutting edges to provide support for an associated blades.

The invention also covers a kit of interchangeable different style utility knife blades that includes a plurality of blade holders each for holding a different style blade, as suggested above, each blade holder being selectively attachable to or detachable from the handle for performing different cutting functions. The kit includes at least a standard utility blade 26 with a straight cutting edge, a hook blade 24 with a concave cutting edge, and a scalpel-type blade with a convex cutting edge as respectively shown in FIGS. 1-3. The aforementioned blades that can be included in the kit are not exclusive of other shaped blades as long as the parameters or relative dimensions discussed above are generally satisfied.

While the invention has been shown and described with reference to certain embodiments thereof, it will be understood by those skilled in the art that various changes in form and detail may be made therein without departing from the spirit and scope of the invention as defined by the appended claims and their equivalents.

What is claimed:

1. An interchangeable different-blade utility knife comprising a generally elongate handle having a proximal end and a distal end along a handle axis; a blade holder; actuating means on said handle for selectively attaching and detaching said blade holder to said distal end of said handle at a parting line; a blade supported by said blade holder and having an exposed cutting edge generally along a lower side of said handle and having a projected predetermined length along said axis, and said blade holder having a support upper portion generally along an upper side of said handle from said parting line to a distal end of said support upper portion and having a projected length along said axis substantially equal to said predetermined length of said exposed cutting edge to provide support for said blade.

2. An interchangeable different-blade utility knife as in claim 1, wherein said actuating means comprises a latch for securing said blade holder to said distal end of said handle, and a button on the exterior of said handle accessible to a user for releasing said latch and enabling separation of said blade holder from said handle.

3. An interchangeable different-blade utility knife as in claim 1, wherein said handle has an internal cavity; and pivot means on said handle for pivoting said blade holder from an extended position generally coextensive with said axis for use of the utility knife to a retracted position within said cavity for storage.

4. An interchangeable different-blade utility knife as in claim 1, wherein said blade is a standard utility blade with a straight edge.

5. An interchangeable style-blade utility knife as in claim 1, wherein said blade is a hook blade with a concave cutting edge.

6. An interchangeable different-blade utility knife as in claim 1, wherein said blade is a scalpel-type blade with a convex cutting edge.

7. An interchangeable different-blade utility knife as in claim 1, wherein said blade holder has a distal end, and said blade has an upper exposed edge forwardly extended along a projected length along said axis, and said forwardly extended lengths being substantially equal for all blade types irrespective of said projected predetermined length of said cutting edges.

8. A kit of interchangeable-style utility knife in accordance with claim 1, comprising a plurality of blade holders each for holding a different style blade, each blade holder being selectively attachable to and detachable from said handle for performing different cutting functions.

9. A kit for interchangeable-style utility knife as in claim 8, wherein said kit includes blade holders with differently shaped blades.

10. A kit for interchangeable-style utility knife as in claim 9, wherein said blades include a standard utility blade with a straight cutting edge, a hook blade with a concave cutting edge, and a scalpel-type blade with a convex cutting edge.

11. A kit of interchangeable different-style blade utility knife comprising a generally elongate handle having a proximal end and a distal end along a handle axis; a plurality of blade holders; actuating means on said handle for selectively attaching and detaching said blade holders to said distal end of said handle at a parting line; a blade of a predetermined style supported by an associated blade holder for holding said predetermined style blade and having an exposed cutting edge generally along a lower side of said handle and having a projected predetermined length along said axis, and each blade holder having a support upper portion generally along an upper side of said handle from said parting line to a distal end of said support upper portion and having a projected length along said axis substantially proportional to said predetermined length of an associate blade exposed cutting edge of said exposed cutting edge to provide support for said blade.

12. A kit of interchangeable different-style blade utility knife as in claim 11, wherein said handle has an internal cavity; and pivot means on said handle for pivoting said blade holder from an extended position generally coextensive with said axis for use of the utility knife to a retracted position within said cavity for storage.

13. A kit of interchangeable different-style blade utility knife as in claim 11, wherein said blade is a standard utility blade with a straight edge.

14. A kit of interchangeable different-style blade utility knife as in claim 11, wherein said blade is a hook blade with a concave cutting edge.

15. A kit of interchangeable different-style blade utility knife as in claim 11, wherein said blade is a scalpel-type blade with a convex cutting edge.

* * * * *